United States Patent [19]

Lautenschlaeger

[11] 3,977,042

[45] Aug. 31, 1976

[54] FURNITURE HINGE

[75] Inventor: Karl Lautenschlaeger, Reinheim, Odw., Germany

[73] Assignee: Karl Lautenschlager KG, Germany

[22] Filed: Jan. 9, 1975

[21] Appl. No.: 539,648

[30] Foreign Application Priority Data

Jan. 16, 1974 Germany ..... 2401865

[52] U.S. Cl. ..... 16/130

[51] Int. Cl.[2] ..... E05D 7/04

[58] Field of Search ..... 16/129, 130, 131, 132, 16/133, 134, 128 R, DIG. 33, 136, 137, 166, 168

[56] References Cited

UNITED STATES PATENTS

| | | | |
|---|---|---|---|
| 2,545,378 | 3/1951 | Peck | 16/130 X |
| 2,581,104 | 1/1952 | Houlsby | 16/129 |
| 2,615,194 | 10/1952 | Kreiner | 16/129 |
| 3,019,472 | 2/1962 | Wasmuth | 16/129 |
| 3,772,735 | 11/1973 | Lautenschlaeger | 16/129 |

*Primary Examiner*—G. V. Larkin

*Attorney, Agent, or Firm*—Hill, Gross, Simpson, Van Santen, Steadman, Chiara & Simpson

[57] ABSTRACT

A furniture hinge in which the portion to be attached to a furniture door is adjustable with respect to the portion which is to be attached to the furniture carrier wall in the direction of the hinge pivot axis.

12 Claims, 5 Drawing Figures

FURNITURE HINGE

This invention relates to furniture hinges for furniture doors.

It has become desirable to provide a furniture door hinge in which the portion of the hinge attached to the door is adjustable with respect to that portion which is connected to the furniture carrier wall in the direction of the hinge pivot axis. It should be evident that this adjustability feature is desirable to permit a more precise fitting of the door with respect to the door frame. Such an adjustability feature becomes particularly important when dealing with glass doors because glass doors cannot be subjected to mechanical stresses which result from improperly fitting doors. The possibility of more exact fitting is also a highly desirable feature in the case of kitchen furniture, for example, where it often becomes necessary to align as precisely as possible doors having certain handle arrangements to thereby satisfy aesthetic requirements. The scope of the invention obviously is not limited to glass doors or to doors for kitchen furniture but is useful for doors generally.

The problem of vertical alignment has existed for a long time. Previous methods for solving this problem have not been entirely satisfactory.

In certain prior art constructions that part of the hinge to be attached to the carrier wall of the furniture usually comprises a longitudinally extending carrier arm which is attached indirectly to the carrier wall with the help of an adaptor mounting plate.

In the hinge of the present invention the carrier arm comprises two assembled parts, namely, an upper part supporting the hinge joint and a lower part, which is to be directly attached to the mounting plate with means being provided for adjusting the upper part relative to the lower part in transverse direction.

SUMMARY OF THE INVENTION

It is an object of the present invention to provide a furniture hinge with a carrier arm having two parts which are adjustable with respect to each other in a direction substantially parallel to the hinge axis.

It is another object of the invention to provide a furniture hinge with a carrier arm having two parts and wherein both parts may be easily secured to a mounting plate.

Another object of the invention is to provide a hinge including a pair of carrier arms which are adjustable with respect to each other in a direction substantially parallel to the hinge axis and wherein the carrier arm means is adjustable with respect to the mounting plate in a direction transverse to the hinge axis.

DESCRIPTION OF A PREFERRED EMBODIMENT

In the embodiment illustrated there is shown a furniture hinge whose joint utilizes a quadrilateral link mechanism having a pair of link members. The invention, however, is not limited to hinges having such a joint.

Figure 1:
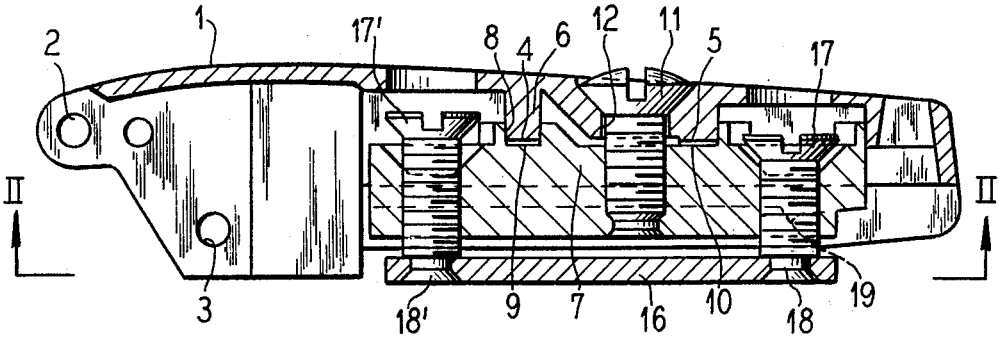
FIG. 1 is a plan view in horizontal section showing the carrier arm of a hinge secured to a mounting plate and embodying the invention herein.
Figure 2:
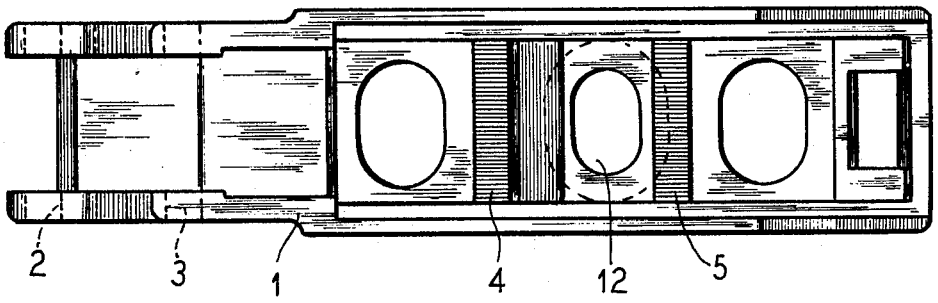
FIG. 2 is a bottom view of the upper part of the carrier arm taken along line II—II of FIG. 1 with the lower part of the carrier arm removed.

In the hinge unit of FIGS. 1 and 2, two bores 2 and 3 in an upper part 1, i.e., an upper carrier arm portion, are required in the case of the illustrated hinge for the pivot pins of the two links of the quadrilateral link mechanism. The upper part 1 in the present case may be made as a zinc die casting. However, it may also be produced from a steel sheet by a stamping or deep-drawing process.

Two serrated or ribbed surfaces 4 and 5 are arranged on the underside of upper part 1, parallel to the imaginary pivot axis of the hinge, i.e. transverse to the longitudinal direction of movement of the carrier arm. The transverse surface 4 is formed on the face of a tongue or projecting portion 6 formed on the rear portion of the carrier arm.

Figure 3:
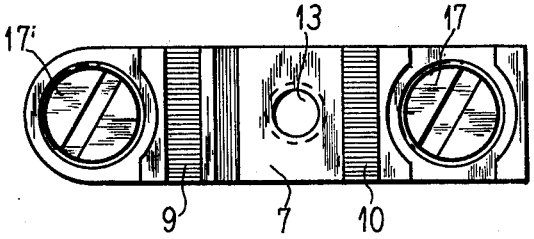
FIG. 3 is a top plan view of the lower part of the carrier arm.
Figure 4:
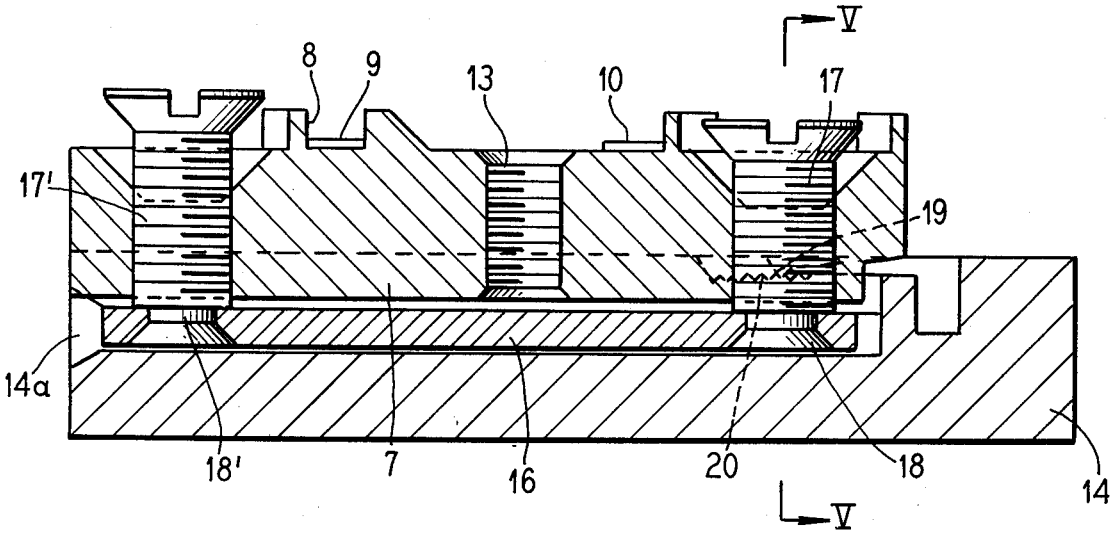
FIG. 4 is a plan view in section of the lower part of the carrier arm and the mounting plate taken through line IV—IV of FIG. 5.

In order to obtain an exact fitting of the upper part 1 onto a lower carrier arm portion or lower part 7, the latter comprises a corresponding transverse groove 8 for receiving the projecting portion 6. The cross-sectional dimension of the groove 8 corresponds to that of the projection 6, so that the projection 6 forms a close sliding fit with the groove 8. The bottom of this transverse groove 8, namely the surface 9, is also provided with transverse ribs or serrations as can be seen in FIGS. 3 and 4. A similar ribbed or serrated surface 10 is formed on the lower part 7 opposite to the ribbed surface strip 5 of the upper part 1. Thus, the upper part 1, as long as it is only loosely placed onto the lower part 7, can be easily shifted transversely of the lower part 7 and can be brought into the desired transverse adjustment with respect to the lower part. With the help of a screw 11 which is inserted through a substantially oblong opening 12 in the upper part and which is screwed into the threaded bore 13 of the lower part 7, the upper part 1 can be fixed in a desired position with respect to lower part 7.

Figure 5:
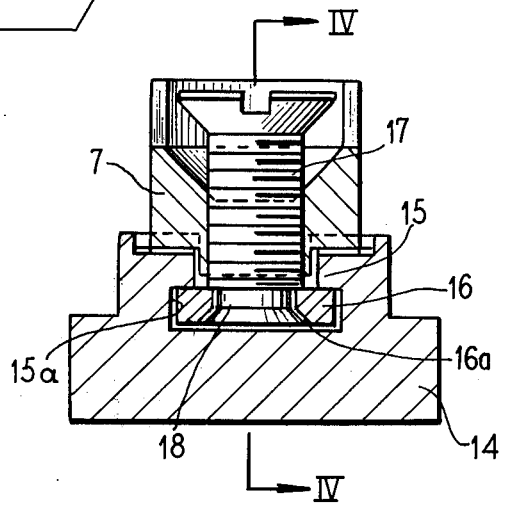
FIG. 5 is a vertical end view in section taken along line IV—IV of FIG. 4.

FIGS. 4 and 5 illustrate how the lower part 7 of the carrier arm is attached to a mounting plate 14 of the furniture piece. This mounting plate 14, as can be seen in FIG. 5, has the shape of a longitudinal channel of a generally U-shaped cross-section. The mounting plate 14 has marginal inwardly extending flanges 15 which extend over the mouth of the channel. A longitudinally extending clamping plate 16 is positioned within the channel which is open at one end 14A (at the left end as shown in FIG. 4). This clamping plate 16 is held by two internally threaded screws 17 and 17' in cooperation with screws 18 and 18' extending through the clamping plate 16.

The openings in the clamping plate 16 through which the screws 18 and 18' extend may comprise slots **16*a* extending transversely to the longitudinal axis of the clamping plate, so that, after the screws 17 and 17' have been placed into the lower part 7, the clamping plate 16 can be shifted from side to side over the necks of the screws 17 and 17' which are positioned between the heads 18 or 18' respectively, and the threaded spindles of the screws 17 or 17'**, respectively.

When the clamping plate 16 has been attached to the lower part 7 this combination can be placed into the mounting plate 14, from its open end (from the left in FIG. 4) so that the clamping plate 16 is then positioned within the channel 15A of the mounting plate 14. Finally the attachment of the lower part 7 to the mounting plate 14 is effected by tightening the screw 17. Thus, the two marginal flanges 15 of the mounting plate 14 are clamped between the clamping plate 16 and the lower surface of the lower part 7. The lower part 7 is thus firmly secured to the mounting plate 14 since the lower surface of the lower part 7 in the illustrated embodiment is provided with a transverse rib 19, on both sides which engage the transverse corrugations 20 on the upper face of the marginal flanges 15. Finally, an exact adjustment in the vertical position can be effected securing upper part 1 to lower part 7 by means of the screw 11.

It should be noted that an attachment with the help of a clamping plate 16 may, of course, also be used for other types of hinges in which the carrier arm does not comprise two parts or is transversely adjustable.

Thus, it is apparent that I have advantageously provided a hinge construction wherein both vertical and lateral adjustment of the hinge may be made so that the position of a door with which the hinge is used may be easily adjusted.

While a preferred embodiment of the invention has been disclosed it will be appreciated that this has been shown by way of example only, and the invention is not to be limited thereto as other variations will be apparent to those skilled in the art and the invention is to be given its fullest possible interpretation within the terms of the following claims.

What is claimed is:

1. A furniture hinge for attachment to a carrier wall of a piece of furniture comprising:

an elongated upper carrier arm portion adapted to carry a hinge joint;

an elongated lower carrier arm portion adapted for attachment to a mounting plate which in turn is adapted to be secured to said carrier wall;

means for adjustably securing said upper and lower carrier arm portions to each other so that said upper and lower carrier arm portions may be moved transversely relative to each other; and cooperating means on each of said upper and lower carrier arm portions allowing selective adjustability of said upper carrier arm portion with respect to said lower carrier arm portion, said cooperating means comprising cooperating tongue and groove means formed on said upper and lower carrier arm portions and cooperating serrated surfaces formed on and extending transversely to said tongue and groove means to effect a secure positioning of the tongue portion with respect to the groove portion.

2. A furniture hinge for attachment to a carrier wall of a piece of furniture comprising:

an elongated upper carrier arm portion adapted to carry a hinge joint;

an elongated lower carrier arm portion adapted for attachment to a mounting plate which in turn is adapted to be secured to said carrier wall;

means for adjustably securing said upper and lower carrier arm portions to each other so that said upper and lower carrier arm portions may be moved transversely relative to each other; and cooperating means on each of said upper and lower carrier arm portions allowing selective adjustability of said upper carrier arm portion with respect to said lower carrier arm portion, wherein said cooperating means comprise a pair of longitudinally spaced, transversely extending tongue and groove arrangements formed on said upper and lower carrier arm portions and means formed on the mating tongue and groove surfaces to effect a secure positioning of the tongue portion with respect to the groove portion.

3. A furniture hinge for attachment to a carrier wall of a piece of furniture comprising:

an elongated upper carrier arm portion adapted to carry a hinge joint;

a longitudinally extending U-shaped mounting plate formed with inwardly extending flanges at the mouth thereof, said mounting plate defining a channel;

an elongated lower carrier arm portion adapted for attachment to said mounting plate;

means for adjustably securing said upper and lower carrier arm portions to each other so that said upper and lower carrier arm portions may be moved transversely relative to each other;

a longitudinally extending clamping plate disposed in said channel; and screw means interconnecting said lower carrier arm portion and said clamping plate to secure said lower carrier arm portion to said mounting plate.

4. The furniture hinge of claim 3 including second screw means for securing said upper carrier arm portion to said lower carrier arm portion.

5. The furniture hinge of claim 3 including cooperating means on said lower carrier arm portion and said mounting plate for selectively longitudinally positioning said last two named elements relative to each other.

6. The furniture hinge of claim 5 wherein said cooperating means comprising a transverse rib on one of said lower carrier arm portion or said mounting plate and a plurality of serrations on the other of said lower carrier arm portion or said mounting plate adapted to receive said transverse rib whereby said lower carrier arm portion and said mounting plate may be secured against relative movement when said screw means interconnecting said lower carrier portion and said clamping plate is tightened.

7. The furniture hinge of claim 6 including second screw means for securing said upper carrier arm portion to said lower carrier arm portion.

8. A furniture hinge for attachment to a carrier wall of a piece of furniture comprising:

an elongated upper carrier arm portion adapted to carry a hinge joint;

an elongated lower carrier arm portion;

cooperating tongue and groove means formed on said upper and lower carrier arm portions and cooperating means formed on facing tongue and groove surfaces to effect a secure positioning of the tongue portion with respect to the groove portion;

means for adjustably securing said upper and lower carrier arm portions to each other so that said upper and lower carrier arm portions may be moved transversely relative to each other;

a longitudinally extending U-shaped mounting plate formed with inwardly extending flanges at the mouth thereof, said mounting plate defining a channel;

a longitudinally extending clamping plate disposed in said channel; and screw means interconnecting said lower carrier arm portion and said clamping plate to secure said lower carrier arm portion to said mounting plate.

9. The furniture hinge of claim 8 including cooperating means on said lower carrier arm portion and said mounting plate for adjustably positioning said last two named elements relative to each other.

10. A furniture hinge for attachment to the carrier wall of a piece of furniture comprising:

carrier arm means adapted to carry a hinge joint;

a longitudinally extending U-shaped mounting plate adapted to be secured to the carrier wall of a piece of furniture, said U-shaped mounting plate being formed with inwardly extending flanges at the mouth thereof and defining a channel;

a longitudinally extending clamping plate disposed in said channel; and screw means interconnecting said carrier arm means and said clamping plate whereby said carrier arm means may be tightly secured to said mounting plate when said carrier arm means and said clamping plate are drawn tightly together to clamp onto said inwardly extending flanges.

11. The furniture hinge of claim 10 wherein said mounting plate channel is open at one end so that said clamping plate may be slid thereinto.

12. The furniture hinge of claim 10 including cooperating means on said carrier arm means and said mounting plate for selectively positioning said carrier arm means in a plurality of relative longitudinal positions with respect to said mounting plate.

* * * * *